US005899095A

United States Patent [19]

Spillane

[11] Patent Number: 5,899,095

[45] Date of Patent: May 4, 1999

[54] JACQUARD FABRIC AND METHOD OF MANUFACTURING

[75] Inventor: Robert Thomas Spillane, Greensboro, N.C.

[73] Assignee: Liberty Fabrics, Gordonsville, Va.

[21] Appl. No.: 09/009,731

[22] Filed: Jan. 21, 1998

[51] Int. Cl.[6] ..... D04B 21/00

[52] U.S. Cl. ..... 66/207; 66/195; 364/470.12

[58] Field of Search ..... 66/195, 207; 364/470.12

[56] References Cited

U.S. PATENT DOCUMENTS

| | | |
|---|---|---|
| T953,009 | 12/1976 | Neuhaus . |
| T962,002 | 9/1977 | Moore . |
| 3,685,319 | 8/1972 | Jackson . |
| 3,802,226 | 4/1974 | Kohl . |
| 3,834,193 | 9/1974 | Wilkens . |
| 3,864,941 | 2/1975 | Kühn . |
| 3,898,820 | 8/1975 | Brand . |
| 4,137,734 | 2/1979 | Kohl . |
| 4,197,725 | 4/1980 | Kohl . |
| 4,307,587 | 12/1981 | Baesgen et al. . |
| 4,312,196 | 1/1982 | Englert . |
| 4,389,860 | 6/1983 | Schneider . |
| 4,411,142 | 10/1983 | Regenstein . |
| 4,546,026 | 10/1985 | Kowalski . |
| 4,549,414 | 10/1985 | Zorini et al. . |
| 4,570,462 | 2/1986 | Roth . |
| 4,612,784 | 9/1986 | Plath . |
| 4,688,403 | 8/1987 | Gajjar . |
| 4,733,546 | 3/1988 | Toda . |
| 4,748,078 | 5/1988 | Doi et al. . |
| 4,817,400 | 4/1989 | Baesgen et al. . |
| 4,926,660 | 5/1990 | Takashi . |
| 5,029,457 | 7/1991 | Gajjar . |
| 5,031,422 | 7/1991 | Plath . |
| 5,172,570 | 12/1992 | Wade et al. . |
| 5,241,842 | 9/1993 | Hagel . |
| 5,275,022 | 1/1994 | Stoll et al. . |
| 5,284,034 | 2/1994 | Weis et al. . |
| 5,307,283 | 4/1994 | Sawazaki et al. . |
| 5,331,828 | 7/1994 | Weis et al. . |
| 5,353,611 | 10/1994 | Wade et al. . |
| 5,491,989 | 2/1996 | Sasaki . |
| 5,515,701 | 5/1996 | Schubert . |
| 5,544,500 | 8/1996 | Speich . |
| 5,561,989 | 10/1996 | Mista . |
| 5,596,888 | 1/1997 | McLarty, III et al. . |
| 5,619,869 | 4/1997 | Tacy . |
| 5,675,993 | 10/1997 | Ono et al. . |
| 5,689,977 | 11/1997 | Yorisue et al. . |
| 5,732,573 | 3/1998 | Sexton ..... 66/195 |
| 5,832,749 | 11/1998 | Antonietti ..... 66/195 |

*Primary Examiner*—Andy Falik
*Attorney, Agent, or Firm*—Kenyon & Kenyon

[57] ABSTRACT

A Jacquard fabric includes a Jacquard yarn plaited into a base knit structure such as, for example, a "Sleeknit" structure. The fabric may be knitted on a warp knitting machine having at least four guide bars, the frontmost guide bar being a Jacquard guide bar, with the Jacquard yarn being knitted in a knit-float-knit sequence. The two middle guide bars are, for example, fully threaded with multifilament synthetic yarns (e.g. Nylon or polyester), which knit on alternate courses and float on alternate courses. The backmost bar may be fully threaded with, for example, an elastomeric fiber (e.g. Lycra Spandex) which may be laid into the structure during knitting. In an exemplary method for producing the fabric of the present invention, the two middle guide bars knit on alternate courses, so that only one of these bars is knitting on any one course. This arrangement allows the Jacquard yarn to be plaited into the same course and stitch as the finer multifilament yarn on the odd-numbered courses, creating a softer fabric. In addition, the fabric may be produced without a dropping of the stitch from the needle, even when the Jacquard guide bar is being deflected.

29 Claims, 4 Drawing Sheets

JACQUARD FABRIC AND METHOD OF MANUFACTURING

FIELD OF THE INVENTION

The present invention relates to warp knitted fabrics, and in particular Jacquard patterned fabrics.

BACKGROUND INFORMATION

Warp knitted Jacquard patterned fabrics as known in the art are generally produced by interlacing continuous filament synthetic yams into a series of interlocking loops. The loops may form a design comprised of underlap floats on the technical back of the fabric. A bright, translucent synthetic yarn may be used, and in particular a monofilament yarn having a generally triangular "prism-like" cross-section. This yarn partially reflects light striking the fabric, giving the fabric an iridescent "glossie" appearance, particularly if the underlying ground yarns directly beneath this face effect yarn are of a different and contrasting color.

While creating an attractive design, the translucent yam typically requires a relatively thick cross section to produce the desired appearance. The thickness of the yarn has a relatively coarse feel. Accordingly, the translucent yarn creates a fabric that is harsh to the touch on the technical face as well as the technical back, making the fabric uncomfortable to wear next to the skin. While improvements to such fabrics have been attempted, for example decreasing the cross section area of the translucent yarn or replacing the monofilament yarn with a multifilament yarn, none of these modifications provides a fabric that retains the desired appearance, yet is soft to the touch on the technical face.

SUMMARY OF THE INVENTION

The fabric of the present invention includes, for example, a translucent monofilament yarn of, for example, relatively low denier plaited into a base knit structure such as, for example, a "Sleeknit" structure. The fabric may be knitted on a warp knitting machine having at least four guide bars, the frontmost guide bar being, for example, a Jacquard guide bar. Such a knitting machine is described in U.S. Pat. No. 5,628,210 to Mista et al., entitled WARP KNITTING METHOD, MACHINE, AND FABRIC MADE THEREFROM ("the '210 patent"), expressly incorporated herein by reference.

The translucent yarn may, for example, be fully threaded onto the Jacquard guide bar. The two middle guide bars are, for example, fully threaded with multifilament synthetic yarns (e.g. Nylon or polyester). These yams may be of finer denier per filament than the translucent yarn. The backmost bar may be fully threaded with, for example, an elastomeric fiber (e.g. Lycra Spandex) which may be laid into the structure during knitting.

In an exemplary method for producing the fabric of the present invention, the two middle guide bars knit on alternate courses, so that, for example, only one of these bars is knitting on any one course. This arrangement allows the translucent yarn of, for example, the front bar to be plaited into the same course and stitch as the finer multifilament yam on the odd-numbered courses, creating a softer fabric. In addition, the fabric may be produced without a dropping of the stitch from the needle, even when, for example, the Jacquard guide bar is being deflected or is floating.

An exemplary method of producing the exemplary fabric utilizes, for example, a Jacquard knitting machine and control device, but does not employ a stitch repeat pattern of two courses in length, as is standard for Jacquard fabrics. Rather, the present invention employs, for example, a stitch repeat of four courses in length. Because the software controlling known Jacquard warp knitting machines generally assumes a two-course repeat stitch, an embodiment of the present invention includes a method of inputting instructions to a fabric design program that translate known stitch commands from a two-course repeat stitch to a four-course repeat stitch.

DETAILED DESCRIPTION OF THE INVENTION

Figure 1:
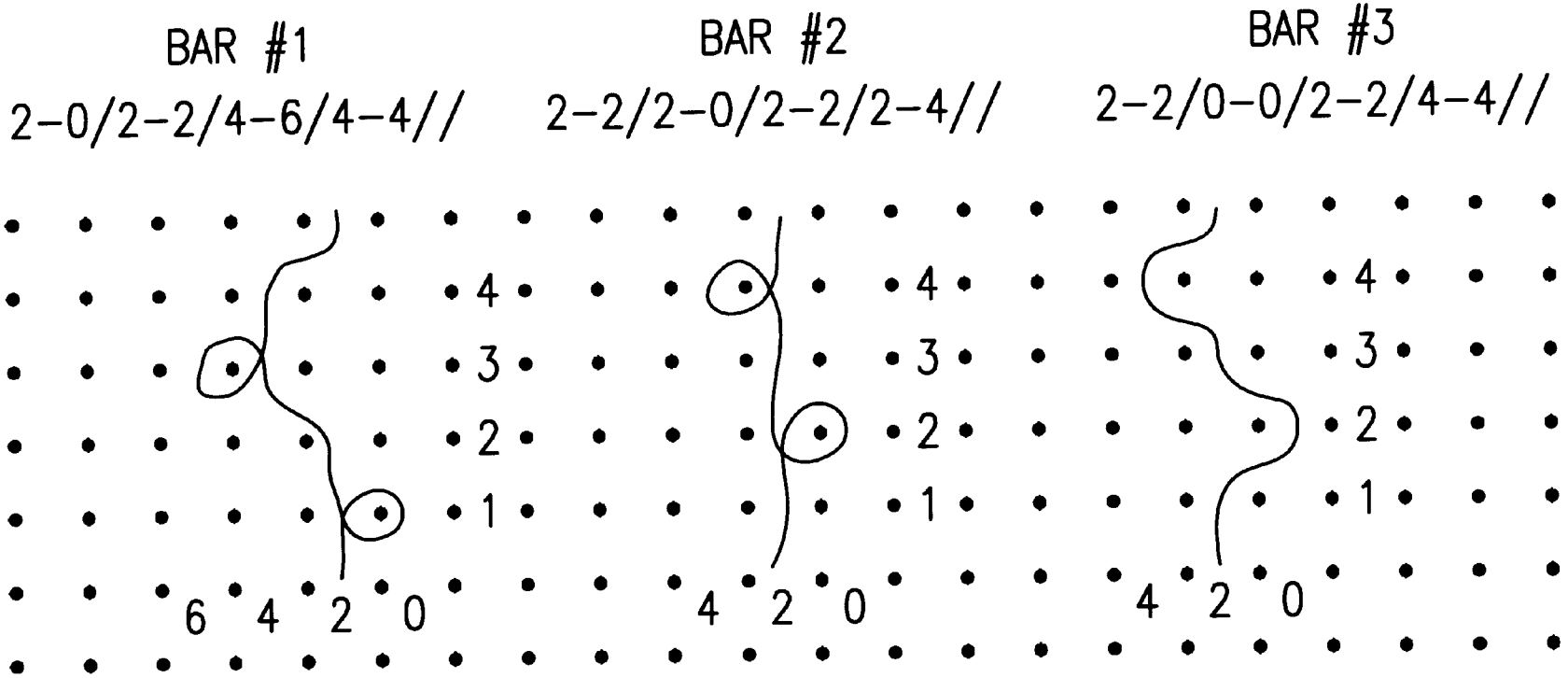
FIG. 1 is a stitch diagram illustrating a stitch pattern of a known fabric.

FIG. 1 illustrates a stitch pattern for a Raschel construction known as "Sleeknit." As can be seen in FIG. 1, the pattern has a four-course stitch repeat. The standard Sleeknit construction includes a rigid yarn threaded on the front fully-threaded guide bar, the rigid yarn knitting on odd numbered courses 1 and 3 and floating on even numbered courses 2 and 4. A rigid yard is also threaded on the fully-threaded middle bar, this yarn floating on odd numbered courses 1 and 3 and knitting on even numbered courses 2 and 4. An elastomeric yarn is threaded on the back bar, the yarn laying in throughout the four-course repeat.

Because one of the yarns is knitting on every course (the front-bar yarn on courses 1 and 3 and the middle-bar yarn on courses 2 and 4), the standard Sleeknit structure does not leave any needles free of yarn. It thus includes no defects or flaws in the fabric caused by a dropping of the stitch from the needle. While this holds true for the standard Sleeknit fabric, one skilled in the art will understand that it does not hold true if the standard front bar is replaced with a compound Jacquard bar. In this latter case, if the Jacquard pattern includes a deflection of a guide on an odd-numbered course, then the front-bar yarn will miss its intended needle rather than knit. The missed needle will therefore be completely empty of knitting yarn, resulting in a dropping of the stitch from the needle. As a result, known Jacquard patterns are limited to a two-course stitch repeat (as shown, for example, in FIG. 3), and do not employ a knit-float-knit construction.

Figure 2:
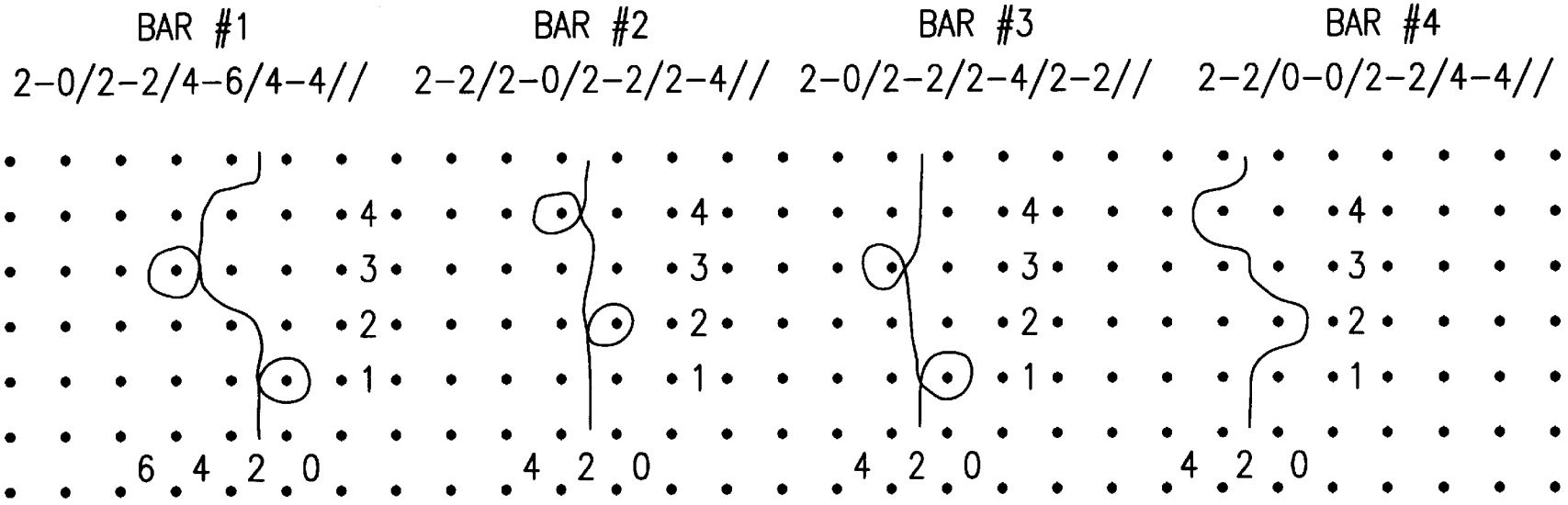
FIG. 2 is a stitch diagram illustrating a stitch pattern of an embodiment of a fabric according to the present invention.

FIG. 2 diagrams the construction of an exemplary Jacquard fabric according to the present invention, which may be termed a "Lace Under Glass" fabric. The fabric may be manufactured, for example, using a Jacquard warp knitting machine of the type described in the '210 patent (referenced above) having at least four guide bars. One skilled in the art can understand that the use of additional bars may be possible. A fabric of the present invention may of course be produced on such machines, and such a fabric will include additional features, such as an additional elastomeric yarn or a laid-in cotton yarn. The potential list of these additional features and embodiments is extensive, and so while an exhaustive list is not included herein, it is to be understood that any such embodiments are contemplated here and are within the scope of the present invention.

A fabric according to the present invention may include any suitable type of yarn threaded onto any of the guide bars. Accordingly, each of the yarns may be natural or synthetic, monofilament or multifilament, of any suitable denier and cross-section.

A preferred fabric according to the present invention includes a translucent yarn threaded onto the front bar (the Jacquard bar). In an exemplary embodiment, this translucent yarn may be a monofilament clear bright trilobal cross-section Nylon of between 10 denier and 100 denier, for example approximately 15 denier. The frontmost middle bar may be threaded with a rigid yarn. In an exemplary embodiment, this first rigid yarn or first middle yarn may be a multifilament cationic dyeable polyester yarn of between 10 and 100 denier, for example approximately 40 denier, having between 2 and 100 filaments, for example approximately 27 filaments. The backmost middle bar may be threaded with a second rigid yarn (which may be the same as or different than the first rigid yarn). In an exemplary embodiment, the second rigid yam or second middle yarn may be a bright multifilament Nylon yarn of between 10 and 100 denier, for example approximately 20 denier, having between 2 and 100 filaments, for example approximately 7 filaments. The back bar may be threaded with an elastomeric yarn. In an exemplary embodiment, the elastomeric yarn or back yarn may be a monofilament Lycra Spandex yarn of between 40 and 400 denier, for example approximately 140 denier. While these exemplary yarns are referred to herein as "translucent," "first rigid," "second rigid," and "elastomeric," other yarns may be used. These terms are used for purposes of clarity, and should not be construed as limitations on the present invention. It may be noted that the yarn of the Jacquard bar may also be referred to as the "Jacquard" yarn.

In a second preferred embodiment of the fabric according to the present invention, the translucent yarn is a multifilament yarn of any denier and any number of filaments. The translucent yarn may, for example, be between 10 and 100 denier and between 2 and 140 filaments. Particular embodiments include yarns of: (1) approximately 40 denier having approximately 13 filaments (2) approximately 40 denier having approximately 34 filaments, and (3) approximately 60 denier having approximately 100 filaments.

As shown in FIG. 2, the yarns of the middle bars knit on alternate courses, with the first rigid yarn knitting, for example, on courses 2 and 4 and the second rigid yarn knitting, for example, on courses 1 and 3. Of course, these knitting patterns may, for example, be reversed, along with the corresponding yarns and stitch diagrams. Because the guide bars maintaining these yarns are not Jacquard bars (e.g. standard cam guide bars), there are no deflections of these bars, ensuring that the first and second rigid yarns will always knit on all needles on alternate courses.

The translucent yarn knits, for example, on odd numbered courses 1 and 3 and floats, for example, on even numbered courses 2 and 4. However, even if a deflection occurs on course 1 or 3 as dictated by the Jacquard pattern (not shown), so that the translucent yarn misses a needle, the second rigid yarn will, for example, still knit on this course and thereby supply yarn to the needle. Accordingly, the Jacquard pattern may be achieved without a dropping of the stitch from the needle and the resulting fabric flaws. Moreover, when the translucent yarn does knit on course 1 or 3, the second rigid yarn also knits, so that the finer, softer, multifilament second rigid yarn is plaited in to the technical face of the fabric along with the relatively coarse translucent yarn. A Jacquard fabric according to the exemplary embodiment of the present invention will therefore be softer to the touch than known Jacquard fabrics.

Table 1 shows the stitch pattern for each of the yarns of the exemplary construction shown in FIG. 2. The translucent yarn follows, for example, a 2-0/2-2/4-6/4-4// repeat pattern; the first rigid yam follows, for example, 2-2/2-0/2-2/2-4// repeat pattern; the second rigid yarn follows, for example, a 2-0/2-2/2-4/2-2// repeat pattern; and the elastomeric yarn follows, for example, a 2-2/0-0/2-2/4-4// repeat pattern.

TABLE 1

Yarn Stitch Patterns

| Yarn | Guide Bar | Pattern |
|---|---|---|
| Translucent | Front (Jacquard) | 2-0/2-2/4-6/4-4// |
| First Rigid | Frontmost Middle | 2-2/2-0/2-2/2-4// |
| Second Rigid | Backmost Middle | 2-0/2-2/2-4/2-2// |
| Elastomeric | Back | 2-2/0-0/2-2/4-4// |

A method of producing a fabric according to the present invention using a Jacquard warp knitting machine having at least four bars includes yarns threaded on two middle bars knitting on alternate courses. An elastomeric yarn may be laid in on all courses, and a translucent yarn may be knitted into the structure in, for example, a knit-float-knit pattern.

Specifically, a method of producing a fabric according to the present invention having a four-course stitch repeat may include the following steps:

on the first course:
- knitting (and deflecting) the translucent yarn,
- floating the first rigid yarn,
- knitting the second rigid yarn, and
- laying in the elastomeric yarn;

on the second course:
- floating (and deflecting) the translucent yarn,
- knitting the first rigid yarn,
- floating the second rigid yarn,
- laying in the elastomeric yarn, on the third course:
- knitting (and deflecting) the translucent yarn,
- floating the first rigid yarn,
- knitting the second rigid yarn, and
- laying in the elastomeric yarn; and on the fourth course;
- floating (and deflecting) the translucent yarn,
- knitting the first rigid yarn,
- floating the second rigid yarn, and
- laying in the elastomeric yarn;

wherein the parenthetical steps (the deflections) are optional, being determined according to the fabric design.

A further aspect of the present invention relates to a method of fabric design which includes a translation of the standard language instructions for a Jacquard knitting machine between a four-course stitch repeat pattern and a two-course stitch repeat pattern. When creating a Jacquard fabric design, a fabric designer or draftsperson typically employs a computer-aided fabric design program to input standard "instructional colors" that designate deflections of guides at certain times. In an exemplary method according to the present invention, designers may employ a translation of the standard colors in order to achieve similar color effects when designing a fabric according to the present invention.

Figure 3:
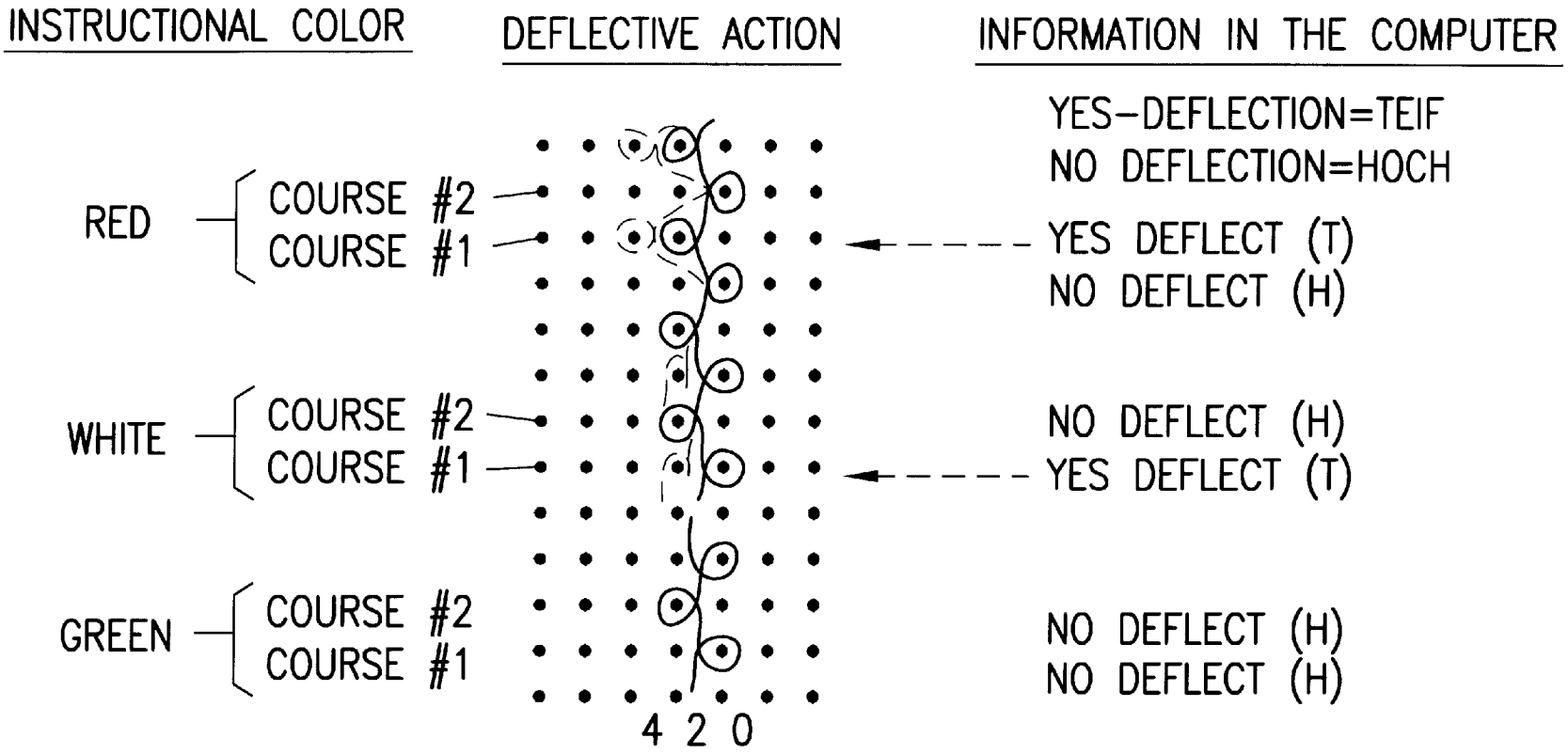
FIG. 3 is a diagram showing standard deflection actions according to known instructional colors.
Figure 4:
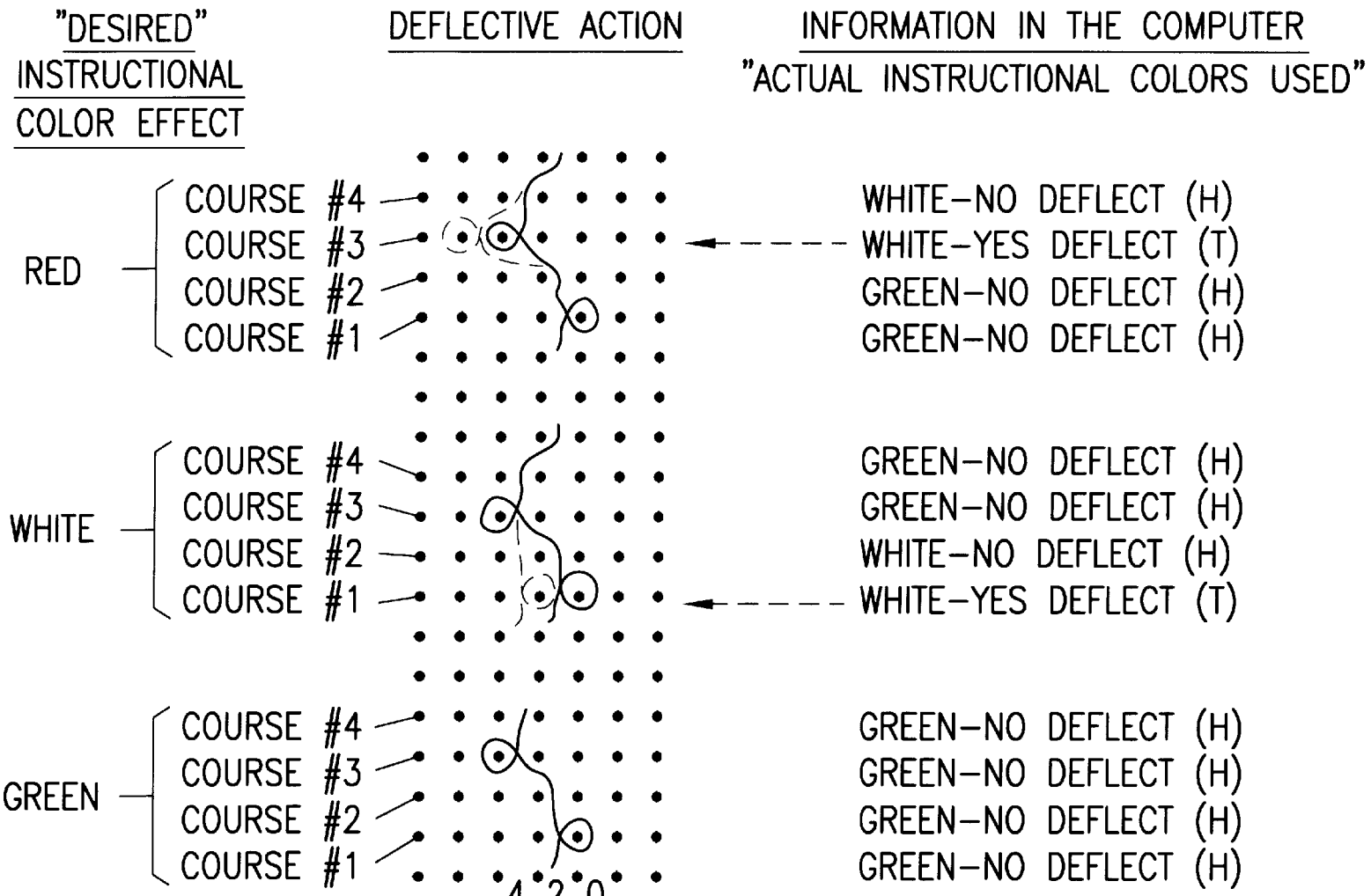
FIG. 4 is a diagram showing a method of producing standard deflection actions for a four-course repeat stitch according to the present invention.

FIG. 3 illustrates the standard instructional colors used to represent deflections of the Jacquard bar during a standard Jacquard knitting sequence, and the corresponding information sent to the control device (e.g. the computer) (not shown). FIG. 4 illustrates an exemplary translation which allows these standard instructional color effects to be achieved for a four-course repeat pattern without, for example, any re-programing of the control device. Using the exemplary method allows fabric designers, for example, to employ standard instructional colors when designing patterns for a fabric of the present invention.

Standard color instructions are illustrated in FIG. 3. For reasons described above, standard Jacquard instructions assume a two-course repeat stitch. The standard control language thus uses two instructional colors to indicate deflections, red to indicate a deflection of a guide and its thread on even-numbered courses (e.g. the second course of a two-course stitch repeat) and white to indicate a deflection of a guide and its thread on odd numbered courses (e.g. the first course of a two-course stitch repeat). Thus in FIG. 3, a red instruction causes a deflection on course 2 and a white instruction causes a deflection on course 1. A green instruction causes no deflection.

FIG. 4 illustrates an exemplary translation from a desired, "effective" instruction, for use with a four-course repeat pattern, to a standard instruction, used with a two-course repeat pattern. The effect of the knit-float-knit construction in FIG. 4 is that each of the courses of FIG. 3 is essentially "broken up" into two new courses, one knitting course and one floating course. In this sense, course 1 of FIG. 3 is "broken up" into courses 1 and 2 of FIG. 4, while course 2 of FIG. 3 is "broken up" into courses 3 and 4 of FIG. 4. The doubling of the number of courses allows, for example, the knit-float-knit sequence of the exemplary embodiment of the present invention.

Just as the two-stitch repeat pattern of FIG. 3 includes two knitting courses 1 and 2, the four-course repeat pattern of FIG. 4 includes two corresponding knitting courses, 1 and 3, respectively. For purposes of the instructional colors use for fabric design, course 1 of the FIG. 3 pattern may, for example, be "mapped" to course 1 of the FIG. 4 pattern. Likewise, course 2 of the FIG. 3 pattern may, for example, be "mapped" to course 3 of the FIG. 4 pattern. Accordingly, a deflection of course 1 of the FIG. 4 pattern results in a "white effect," while a deflection of course 3 of the FIG. 4 pattern results in a "red effect." These red and white effects, however, will not be achieved by applying the standard red and white instructions as normally employed by fabric designers. Instead, the instructions must be translated in order to produce the desired result.

In other words, although each pattern has, for example, two corresponding knitting courses, the standard instructional colors do not provide equivalent deflections in each case. For example, if a deflection of the second knitting course of the FIG. 3 pattern is desired, a red instruction may be sent to the control device. Using standard control programming, the control device applies the red instruction to each course of the two-course repeat pattern (i.e. the control device applies the command to two courses). As described above, the red instruction will cause a deflection of the even-number course, which in the pattern of FIG. 3 is course 2, the second knitting course.

In contrast, the red effect (e.g. a deflection on the second knitting course) is not achieved by applying a standard red instruction to the four-course repeat pattern of FIG. 4. Instead, if a red instruction were submitted to the control device for a four-course repeat of the pattern of FIG. 4, the control device would apply the instruction to the first two courses, and the guide would be deflected on the even course 2 rather than the desired course 3. In addition, no instruction would be available for courses 3 and 4. Even if a red instruction were submitted for courses 3 and 4, the even-numbered course 4 would be deflected rather than the desired course 3. Accordingly, different standard instructions are necessary to achieve a red effect.

As the right-hand column of FIG. 4 indicates, a green instruction followed by a white instruction performs the desired function of deflecting the guide bar on course 3 of the pattern of FIG. 4. The control device, using standard two-course repeat programming, applies the green instruction to courses 1 and 2 (no deflection) and applies the white instruction to courses 3 and 4, causing a deflection on the odd-numbered course 3 and no deflection on the even-numbered course 4. Thus a red effect may be achieved by the designer by inputting a standard green instruction followed by a standard white instruction into the fabric design program.

Similarly, a standard white instruction followed by a standard green instruction achieves a "white effect" for a four-course repeat pattern. Finally, a standard green instruction followed by a standard green instruction achieves a "green effect" (no deflection) for a four-course repeat pattern. These translations allow fabric designers to employ standard instructional notation and commands, for example, while eliminating the need to re-program Jacquard control devices for a four-course repeat pattern.

Thus an exemplary method of achieving standard instructional color effects for a four-course repeat pattern includes inputting a standard green instruction followed by a standard white instruction when a red effect is desired (e.g. when a deflection on the third course is desired), inputting a standard white instruction followed by a standard green instruction when a white effect is desired (e.g. when a deflection on the first course is desired), and inputting a standard green instruction followed by a standard green instruction when a green effect is desired (i.e. when no deflection is desired). These translations are compiled in Table 2.

TABLE 2

Summary of Exemplary Translation Method

| "Effective" Instruction | Desired Effect | Standard Instructions |
|---|---|---|
| Red | Deflection on Second Knitting Course (course 3) | Green<br>White |
| White | Deflection on First Knitting Course (Course 3) | White<br>Green |
| Green | No Deflection | Green<br>Green |

The present invention has been described with respect to specific embodiments. Other embodiments are possible, including, for example, a fabric and method wherein the translucent yarn knits on courses 2 and 4 and floats on courses 1 and 3, with corresponding alterations in the patterns for other bars. In addition, there are many other modifications of the disclosed embodiments which will be apparent to those of skill in the art. It is understood that these modifications are within the teaching of the present invention, which is to be limited only by the claims.

What is claimed is:

1. A Jacquard-patterned fabric produced on a warp knitting machine having at least four guide bars, comprising:

a Jacquard yarn being knitted in a Jacquard pattern;

a first middle yarn being knitted in a knit-float-knit sequence;

a second middle yarn being knitted in a knit-float-knit sequence, wherein the first middle yarn and the second middle yarn knit on alternate courses and float on alternate courses; and a back yarn being laid into the fabric.

2. The fabric according to claim 1, wherein the Jacquard yarn is a monofilament yarn of between 10 and 100 denier, the first middle yarn is a multifilament yarn of between 10 and 100 denier having between 2 and 100 filaments, the second middle yarn is a multifilament yarn of between 10 and 100 denier having between 2 and 100 filaments, and the back yarn is a monofilament yarn of between 40 and 400 denier.

3. The fabric according to claim 2, wherein the first middle yarn has between 10 and 40 filaments and the second middle yarn has between 3 and 20 filaments.

4. The fabric according to claim 3, wherein the Jacquard yarn is a clear bright trilobal Nylon yarn of approximately 15 denier, the first middle yarn is a cationic dyeable polyester yarn of approximately 40 denier having approximately 27 filaments, the second middle yarn is a bright Nylon yarn of approximately 20 denier having approximately 7 filaments, and the back yarn is an elastomeric Spandex yarn of approximately 140 denier.

5. The fabric according to claim 1, wherein the Jacquard yarn is a multifilament yarn of between 10 and 100 denier having between 2 and 140 filaments.

6. The fabric according to claim 5, wherein the Jacquard yarn is of approximately 40 denier having approximately 13 filaments.

7. The fabric according to claim 5, wherein the Jacquard yarn is of approximately 40 denier having approximately 34 filaments.

8. The fabric according to claim 5, wherein the Jacquard yarn is of approximately 60 denier having approximately 100 filaments.

9. The fabric according to claim 1, wherein the Jacquard yarn is knitted in a knit-float-knit sequence, with the Jacquard yarn knitting on the same courses as one of the first middle yarn and the second middle yarn.

10. The fabric according to claim 9, wherein the Jacquard yarn is a monofilament yarn of between 10 and 100 denier, the first middle yarn is a multifilament yarn of between 10 and 100 denier having between 2 and 100 filaments, the second middle yarn is a multifilament yarn of between 10 and 100 denier having between 2 and 100 filaments, and the back yarn is a monofilament yarn of between 40 and 400 denier.

11. The fabric according to claim 10, wherein the Jacquard yarn is a clear bright trilobal Nylon yarn of approximately 15 denier, the first middle yarn is a cationic dyeable polyester yarn of approximately 40 denier having approximately 27 filaments, the second middle yarn is a bright Nylon yarn of approximately 20 denier having approximately 7 filaments, and the back yarn is an elastomeric Spandex yarn of approximately 140 denier.

12. The fabric according to claim 1, wherein the Jacquard yarn follows a 2-0/2-2/4-6/4-4// repeat pattern, the first middle yarn follows a 2-2/2-0/2-2/2-4// repeat pattern, the second middle yarn follows a 2-0/2-2/2-4/2-2// repeat pattern, and the back yarn follows a 2-2/0-0/2-2/4-4// repeat pattern.

13. The fabric according to claim 12, wherein the Jacquard yarn is a monofilament yarn of between 10 and 100 denier, the first middle yarn is a multifilament yarn of between 10 and 100 denier having between 2 and 100 filaments, the second middle yarn is a multifilament yarn of between 10 and 100 denier having between 2 and 100 filaments, and the back yarn is a monofilament yarn of between 40 and 400 denier.

14. The fabric according to claim 13, wherein the Jacquard yarn is a clear bright trilobal Nylon yarn of approximately 15 denier, the first middle yarn is a cationic dyeable polyester yarn of approximately 40 denier having approximately 27 filaments, the second middle yarn is a bright Nylon yarn of approximately 20 denier having approximately 7 filaments and the back yarn is an elastomeric Spandex yarn of approximately 140 denier.

15. A method of producing a Jacquard-patterned fabric on a warp knitting machine having at least four guide bars including a Jacquard bar, a frontmost middle bar, and a backmost middle bar, comprising the steps of:

knitting a Jacquard yarn threaded onto the Jacquard bar in a knit-float-knit sequence;

knitting a first yarn threaded onto the frontmost middle bar in a knit-float-knit sequence; and knitting a second yarn threaded onto the backmost middle bar in a knit-float-knit sequence;

wherein the first yarn and the second yarn are knitted on alternate courses and floated on alternate courses.

16. The method according to claim 15, wherein the Jacquard yarn is knitted on the same courses as one of the first yam and the second yarn.

17. The method according to claim 16, wherein the Jacquard yarn is a monofilament yarn of between 10 and 100 denier, the first middle yarn is a multifilament yarn of between 10 and 100 denier having between 2 and 100 filaments, the second middle yarn is a multifilament yarn of between 10 and 100 denier having between 2 and 100 filaments, and the back yarn is a monofilament yarn of between 40 and 400 denier.

18. The method according to claim 17, wherein the Jacquard yarn is a clear bright trilobal Nylon yarn of approximately 15 denier, the first middle yarn is a cationic dyeable polyester yarn of approximately 40 denier having approximately 27 filaments, the second middle yarn is a bright Nylon yarn of approximately 20 denier having approximately 7 filaments, and the back yarn is an elastomeric Spandex yarn of approximately 140 denier.

19. The fabric according to claim 16, wherein the Jacquard yarn is a multifilament yarn of between 10 and 100 denier and between 2 and 140 filaments.

20. The fabric according to claim 19, wherein the Jacquard yarn is of approximately 40 denier having approximately 13 filaments.

21. The fabric according to claim 19, wherein the Jacquard yarn is of approximately 40 denier having approximately 34 filaments.

22. The fabric according to claim 19, wherein the Jacquard yarn is of approximately 60 denier having approximately 100 filaments.

23. A method for producing a Jacquard patterned fabric, the fabric including a Jacquard yarn knitted by a Jacquard bar, a first yarn, a second yarn, and a back yarn, comprising the steps of:

a. knitting the Jacquard yarn,
floating the first yarn,
knitting the second yarn, and
laying in the back yarn;

b. floating the Jacquard yarn,
knitting the first yarn,
floating the second yarn, and laying in the back yarn;

c. knitting the Jacquard yarn,
floating the first yarn,
knitting the second yarn, and
laying in the back yarn; and d. floating the Jacquard yarn,
knitting the first yarn,
floating the second yarn, and
laying in the back yarn;

wherein guides of the Jacquard bar may be deflected during any of steps a, b, c, and d.

24. The method according to claim 23, wherein the Jacquard yarn is a monofilament yarn of between 10 and 100 denier, the first middle yarn is a multifilament yarn of between 10 and 100 denier having between 2 and 100 filaments, the second middle yarn is a multifilament yarn of between 10 and 100 denier having between 2 and 100 filaments, and the back yarn is a monofilament yarn of between 40 and 400 denier.

25. The method according to claim 24, wherein, the Jacquard yarn is a clear bright trilobal Nylon yarn of approximately 15 denier, the first middle yarn is a cationic dyeable polyester yarn of approximately 40 denier having approximately 27 filaments, the second middle yarn is a bright Nylon yarn of approximately 20 denier having approximately 7 filaments, and the back yarn is an elastomeric Spandex yarn of approximately 140 denier.

26. A method of achieving effective instructional colors for a four-course repeat stitch pattern for or a Jacquard fabric, the four-course repeat including knitting courses on a first course and a third course, comprising the steps of:

inputting to a fabric design program for a no odd course deflection instruction followed by an odd course deflection instruction when a deflection on the third course is desired;

inputting to the fabric design program the odd course deflection instruction followed by the no odd course deflection instruction when a deflection on the first course is desired; and inputting to the fabric design program the no odd course deflection instruction followed by the no odd course deflection instruction when no deflection on the first and third courses is desired.

27. The method according to claim 26, wherein the no odd course deflection instruction is one of a red instruction and a green instruction and the odd course deflection instruction is a white instruction.

28. The method according to claim 27, wherein the no odd course deflection instruction is the green instruction.

29. A method of achieving effective instructional colors for a four-course repeat stitch pattern for a Jacquard fabric, the four-course repeat including knitting courses on a second course and a fourth course, comprising the steps of:

inputting to a fabric design program for a no even course deflection instruction followed by an even course deflection instruction when a deflection on the fourth course is desired;

inputting to the fabric design program the even course deflection instruction followed by the no even course deflection instruction when a deflection on the second course is desired; and inputting to the fabric design program the no even course deflection instruction followed by the no even course deflection instruction when no deflection on the second and fourth courses is desired.

* * * * *